US009391355B2

(12) United States Patent
Tischer

(10) Patent No.: US 9,391,355 B2
(45) Date of Patent: Jul. 12, 2016

(54) MULTI-DIRECTIONAL RECEIVING ANTENNA ARRAY

(71) Applicant: AT&T Intellectual Property I, L.P., Atlanta, GA (US)

(72) Inventor: Steven N. Tischer, Atlanta, GA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 220 days.

(21) Appl. No.: 14/203,040

(22) Filed: Mar. 10, 2014

(65) Prior Publication Data

US 2014/0191917 A1 Jul. 10, 2014

Related U.S. Application Data

(60) Continuation of application No. 13/691,516, filed on Nov. 30, 2012, now Pat. No. 8,669,912, which is a division of application No. 13/187,152, filed on Jul. 20, 2011, now Pat. No. 8,362,966, which is a division of application No. 11/749,373, filed on May 16, 2007, now Pat. No. 7,990,332.

(51) Int. Cl.

| | |
|---|---|
| ***H01Q 9/28*** | (2006.01) |
| ***H01Q 1/12*** | (2006.01) |
| ***H01Q 21/28*** | (2006.01) |
| ***H01Q 21/00*** | (2006.01) |
| ***H01Q 5/40*** | (2015.01) |

(52) U.S. Cl.

CPC ..... *H01Q 1/1235* (2013.01); *H01Q 1/125* (2013.01); *H01Q 5/40* (2015.01); *H01Q 9/285* (2013.01); *H01Q 21/0087* (2013.01); *H01Q 21/28* (2013.01); *Y10T 29/49016* (2015.01)

(58) Field of Classification Search

CPC ..... H01Q 9/28

USPC ..... 343/807, 720, 795, 792.5

See application file for complete search history.

(56) References Cited

U.S. PATENT DOCUMENTS

| | | | | |
|---|---|---|---|---|
| 3,226,069 | A * | 12/1965 | Clarke | F16L 3/227 24/282 |
| 4,205,317 | A * | 5/1980 | Young | H01Q 9/065 343/720 |
| 4,771,290 | A | 9/1988 | Storey, Jr. | |
| 5,969,663 | A | 10/1999 | Fullerton et al. | |
| 6,026,304 | A | 2/2000 | Hilsenrath et al. | |
| 6,094,176 | A * | 7/2000 | Van Hoozen | H01Q 11/105 343/792.5 |
| 6,236,437 | B1 * | 5/2001 | Suzuki | G06F 3/14 343/720 |
| 7,183,993 | B2 * | 2/2007 | Dai | H01Q 9/28 343/795 |
| 7,250,909 | B2 | 7/2007 | Fujishima et al. | |

(Continued)

OTHER PUBLICATIONS

"Antenna (radio)" from Wikipedia, the free encyclopedia, JRL: http://en.wikipedia.org/wiki/Antenna_(radio)> downloaded Apr. 10, 2007, 22 pages.

*Primary Examiner* — Huedung Mancuso

(74) *Attorney, Agent, or Firm* — Abel Law Group, LLP

(57) ABSTRACT

Techniques for providing multi-directional receiving antenna arrays are described herein. According to an embodiment, an apparatus includes an antenna array including multiple antennas and an orientation system. The orientation system includes multiple orientation marks and multiple alignment marks. At least one of the multiple antennas is configured to be positioned toward a respective station transmitter location based at least partially on an alignment of one of the multiple orientation marks relative to one of the multiple alignment marks.

6 Claims, 6 Drawing Sheets

(56) References Cited

U.S. PATENT DOCUMENTS

| | | | |
|---|---|---|---|
| 7,339,542 | B2 | 3/2008 | Lalezari |
| 7,376,428 | B2 | 5/2008 | Hottinen |
| 7,427,962 | B2 | 9/2008 | Yang |
| 7,496,361 | B1 | 2/2009 | Mitchell et al. |
| 7,687,907 | B2 | 3/2010 | Okuda et al. |
| 7,977,165 | B2 | 7/2011 | Okuda et al. |
| 2002/0149521 | A1 | 10/2002 | Hendler et al. |
| 2004/0227682 | A1 | 11/2004 | Anderson |
| 2005/0264452 | A1 | 12/2005 | Fujishima et al. |
| 2006/0119503 | A1 | 6/2006 | Allen et al. |
| 2008/0007253 | A1* | 1/2008 | Takahata ..... G01D 5/2066 324/207.22 |
| 2008/0165079 | A1 | 7/2008 | Smith et al. |

* cited by examiner

MULTI-DIRECTIONAL RECEIVING ANTENNA ARRAY

CLAIM OF PRIORITY

This application is a continuation of U.S. patent application Ser. No. 13/691,516, filed Nov. 30, 2012, which is a division of U.S. patent application Ser. No. 13/187,152, filed Jul. 20, 2011, now U.S. Pat. No. 8,362,966, which is a division of U.S. patent application Ser. No. 11/749,373, filed May 16, 2007, now U.S. Pat. No. 7,990,332, which applications are hereby incorporated herein by reference.

FIELD OF THE DISCLOSURE

The present disclosure relates to antennas, and more specifically to techniques for providing a customized multi-directional receiving antenna array to receive communication signals.

BACKGROUND

Antennas receive radio waves by converting electromagnetic waves into radio frequency electrical currents. Antennas are commonly used in television broadcasting and allow a person to receive programming directly from a provider without paying subscription fees to a cable or network service provider. The introduction and distribution of high-definition signals presents a renewed interest in utilizing antennas to receive over-the-air broadcast signals simultaneously from multiple sources.

SUMMARY

Techniques for providing a multi-directional receiving antenna array are described herein. In different aspects, the techniques may include selecting a location for an antenna array, generating a guide for one or more station signals for the location including a station frequency and a station transmitter location, and generating an antenna array configuration from the guide. The techniques may further include attaching the antennas to the antenna array based on the antenna array configuration.

In other embodiments, an antenna array may include an antenna array base and a plurality of antenna arms extending from the base. Each antenna arm may be configured to receive a directional antenna. A wiring grid may be provided in connection with each antenna arm.

Other systems, methods, and/or computer program products according to embodiments will be or become apparent to one with skill in the art upon review of the following drawings and detailed description. It is intended that all such additional systems, methods, and/or computer program products be included within this description, be within the scope of the present disclosure, and be protected by the accompanying claims.

BRIEF DESCRIPTIONS OF THE DRAWINGS

The teachings herein are described with reference to the accompanying figures. In the figures, the left-most digit(s) of a reference number identifies the figure in which the reference number first appears. The use of the same reference number in different figures indicates similar or identical items.

FIG. 1*a* is an isometric view of an illustrative multi-directional receiving a array 100, showing how an antenna may be organized.

FIG. 1*b* is a plan view of the multi-directional receiving antenna array of FIG. 1*a*.

Figures 4A, 4B, 4C:
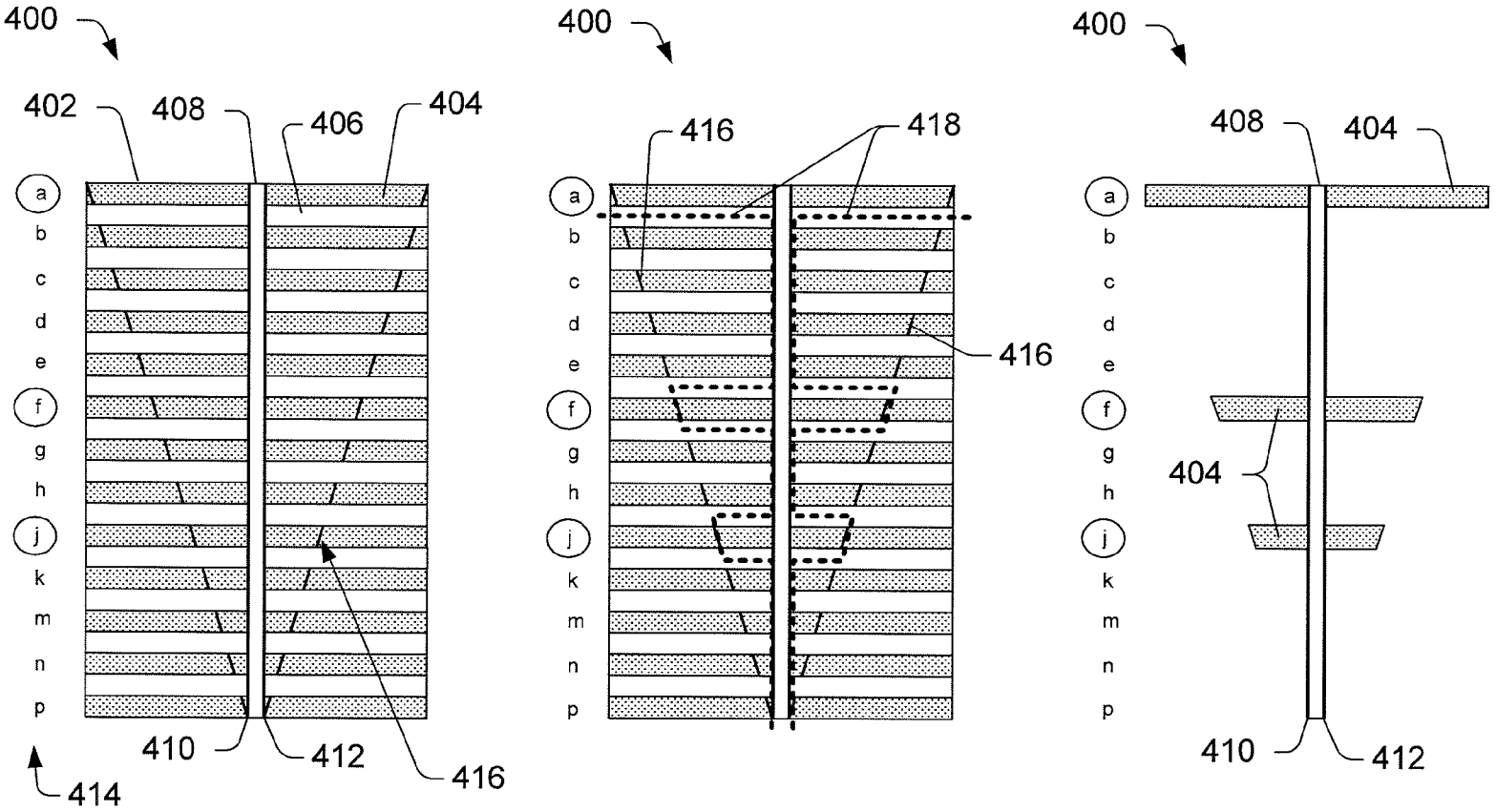

FIGS. 4*a*, 4*b*, and 4*c* are schematics of another illustrative multidirectional receiving antenna allowing customization by a user, showing how an antenna array may be customized.

Figure 4E:
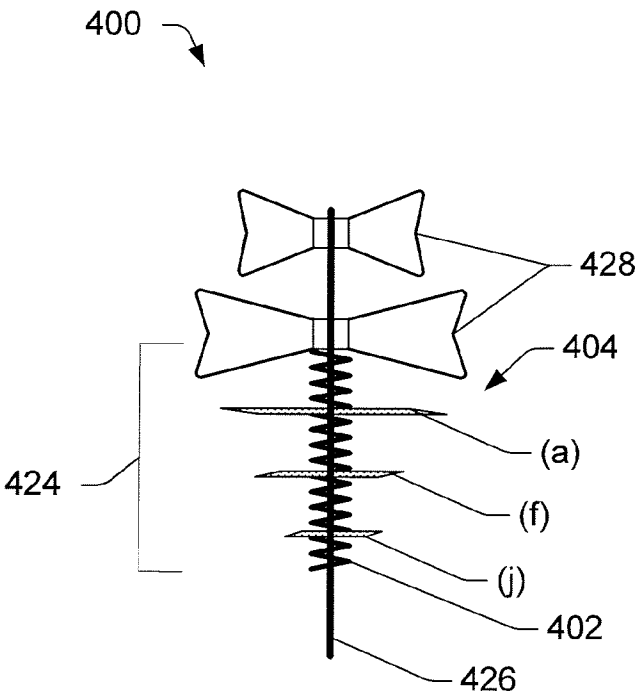
Figure 4D:
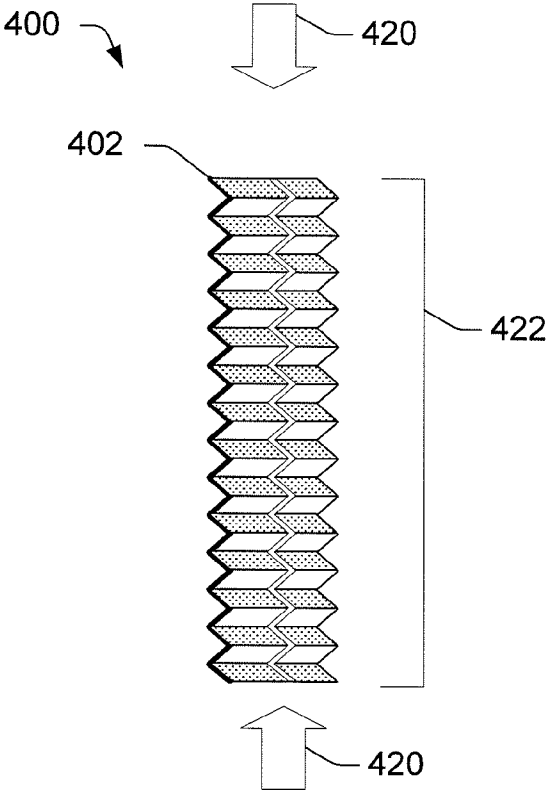

FIGS. 4*d* and 4*e* are isometric views of the multi-directional receiving antenna of FIGS. 4*a*-4*c*, showing how an antenna array may be used.

Figure 5:
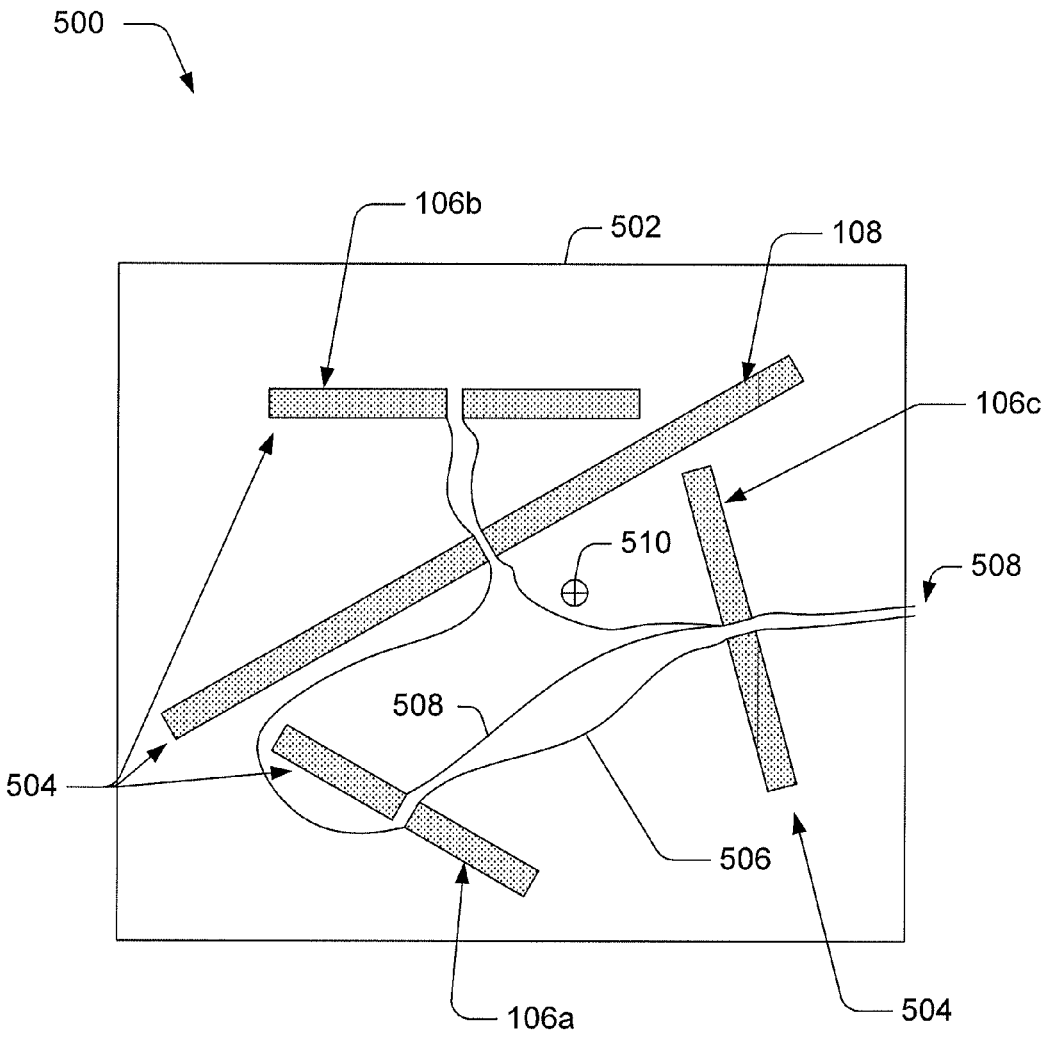

FIG. 5 is a schematic of an illustrative multi-directional receiving antenna array created by a user, showing how an antenna array may be created.

DETAILED DESCRIPTION

High definition television (HDTV) signals, like analog signals, may be transmitted from a broadcaster to a recipient over the air using a transmitting antenna and a receiving antenna. Although HDTV signal transmission is similar to analog signal transmission in that they both use very high frequency (VHF) and ultra high frequency (UHF) signal frequencies and have a modulated carrier wave, important differences exist in the signals and the transmission of these signals. One primary difference is that HDTV signals are transmitted in digital "packets" while analog signals utilize amplitude-modulated (AM) signals for pictures and frequency modulation (FM) for audio, The digital packets of HDTV present an all-or-nothing signal reception dilemma for receivers (viewers). Unlike the analog fuzz that may be received from an improperly tuned antenna receiving an analog signal, HDTV is either tuned properly and thus provides a perfect signal or is tuned improperly and receives no signal (i.e., a black screen on the display connected to the tuner).

It is advantageous to receive HDTV signals over the air for a number of reasons. First, there are no subscription fees for HDTV signals transmitted directly from broadcasters. Second, the over the air HDTV signal may be higher in quality than a HDTV signal provided by a cable or network service provider because cable and network service providers often compress signals before transmitting the signals through their relatively narrow bandwidth transmission conduits. In addition, some content channels may be digitized another generation down in order to be shown on proprietary systems such as satellite television. Sub-channels of digital information, such as channels 46-1, 46-2 etc., that are sub-channels of a channel number 46 may also be transmitted over-the-air.

While receiving HDTV signals over the air may be advantageous, it may also provide a challenge for some receiving locations. A receiving location (typically a residential home) that is centrally located between multiple transmitting stations may not be able to receive all of the HDTV signals with one unidirectional antenna unless the antenna is repositioned each time a different HDTV signal is requested, such as after a channel change. Repositioning is necessary to effectively aim toward each transmitting station's tower direction. Repositioning the antenna can be time consuming, costly, and unreliable, and therefore does not provide an optimum solution for most users. Omnidirectional antennas typically do not have the ability to effectively receive HDTV from multiple sources because they characteristically include a tradeoff of a lowered gain to create a relatively wide signal reception pattern. Increased gain, and thereby increased likelihood of HDTV signal reception, is provided by unidirectional high gain antennas, such as dipole antennas or Yagi-Uda antennas. Therefore, multiple unidirectional antennas may be necessary to receive a number of channels via over the air broadcasting.

Figure 1B:
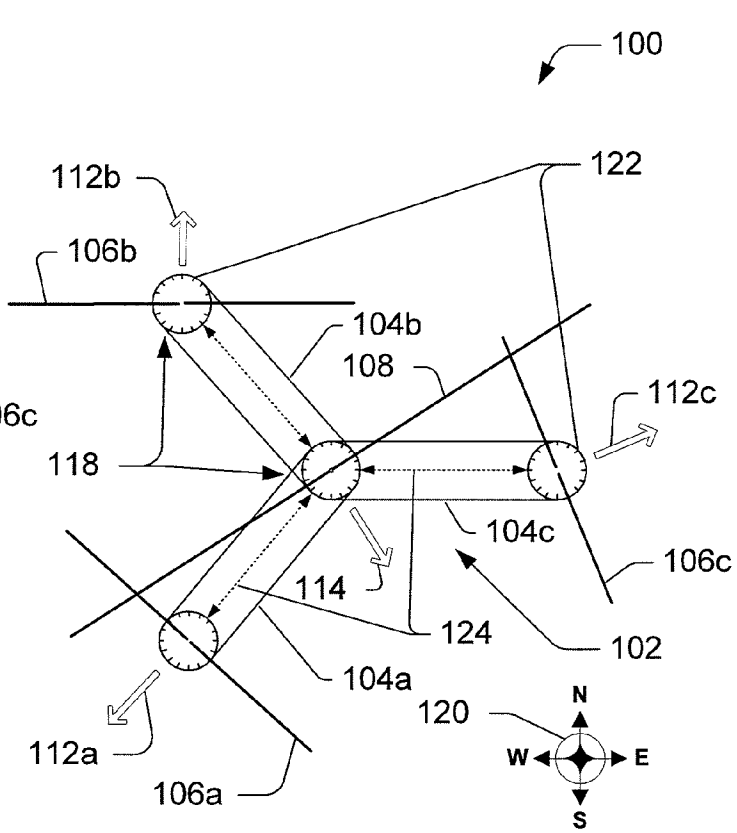
Figure 1A:
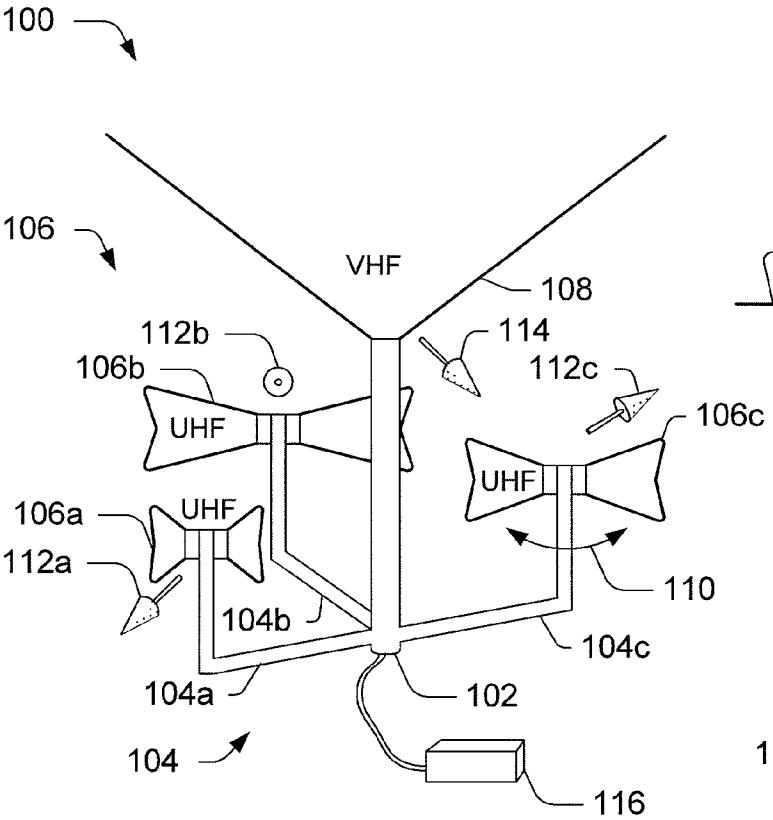

FIG. 1*a* is an isometric view of a multi-directional receiving antenna array 100, showing how such an antenna may be organized. The antenna array 100 includes a base 102. The base 102 may be configured to be mounted at a receiving location, such as the rooftop of a house. For example, the base 102 may include a rotary component and an adjustable angled section (not shown) that may accommodate mounting the base on an inclined surface orientated in any direction. However, in other embodiments, the base 102 may be configured to couple the antenna array 100 to any other desired surface or object.

The antenna array 100 further includes one or more arms 104 that are configured for attachment to the base 102. The arms 104 may extend from the base 102 in any direction. For example, arms 104*a*, 104*b*, and 104*c* may extend from the base 102 in an approximately perpendicular direction (relative to the base) with an even angular spacing between the arms (e.g., 120° apart for each of three arms in the illustrated embodiment). In some embodiments, the arms 104 may attach to the base 102 using fasteners such as screws, clamps, or the like. In other configurations, the arms 104 may join into complimentary mating features in the base 102 to provide a secure attachment between the arms 104 and the base 102. In addition, the arms may be constructed of a non-conductive material. The arms may also include telescoping segments to allow adjustment of arm length.

The arms 104 are further configured to receive antennas 106, such as antennas 106*a*, 106*b*, and 106*c*. The antennas 106 may be attached to the arm 104 using fasteners such as screws, clamps, or the like, or the antennas may mate with complementary mating features in the arm to create a secure attachment. In other embodiments, the antennas 106 may be attached directly to the base 102, such as an antenna 108 which is attached to the base. The antenna 108 may be attached using similar attachment techniques as those provided for the antennas 106.

The antennas 106 may be attached to the arms 104 and rotatable about an axis at a rotation point, such as an axis approximately perpendicular to the horizon. The rotation point may be located at the connection point between the antenna and arms 104, or the rotation point may be configured separately in the arms 104 or the antennas 106. The rotation of the antennas 106 allows the antenna to be directed at a signal transmitter (not shown). For example, the antenna 106*c* may be rotated 110 to orient the antenna 106*c* in a direction 112*c* corresponding to the direction of the signal transmitter. Likewise, the antennas 106*a*, 106*b*, and 108 may be rotated to be oriented in a corresponding transmitter direction 112*a*, 112*b*, and 114, respectively. Further, the rotation point may include a locking mechanism to restrain the antennas 106 in the preferred orientation.

The antennas 106, 108 may also be selected to receive a frequency transmitted by the transmitter each antenna is directed towards. The antennas 106, 108 may receive a VHF or UHF signal. The antennas 106, 108 may include a bow tie (or UHF fan dipole) antenna configured to receive a HDTV signal transmitted from the direction 112*c*. The antennas 106, 108 may also be Yagi-Uda antenna, loop antennas, dipole antennas, or other directional antennas. For example, the antenna 108 may be a telescoping or fixed length dipole antenna tuned to receive a VHF signal frequency. The antennas 106, 108 may be interchangeable among the arms 104, or the antennas may be specific to a particular arm, such as the arm 104*a*. For example, in the illustrated embodiment, the antenna 106*a* requires the specific arm 104*a*, such as an arm with additional support strength, length, or other feature associated with the proper use and installation of the antenna 106*a* with the base 102. The antennas, 106, 108, the arms 104, and the base 102 may be insulated from one another to minimize signal interference. The antennas 106, 108 may further include shields to prevent interference from other antennas included in the antenna array 100. While the antenna array 100 is shown in FIG. 1*a* as having three arms 104, each with an antenna, such as the antennas 106*a*, 106*b*, and 106*c*, in other implementations, the antenna array 100 may have any number and combination of one or more arms and/or antennas. Moreover, the arms 104 and/or antennas 106, 108 may be oriented in any suitable orientation or configuration to effectively receive broadcast signals.

The antennas 106, 108 may be configured with a connector 116, such as a circuit wiring box, to facilitate connection between the antennas 106, 108, and a television tuner for receiving the television signals. In some embodiments, the base 102, arms 104, or antennas 106, 108, or any combination thereof, may be configured with integrated wiling to facilitate a plug-and-go installation of the antennas, arms, base, and/or connector 116. For example, the antenna 106*b* may include two wire leads that connect to the arm 104*b* when the antenna is attached to the arm. The arm 104*b* may include two wires that connect to the base 102 when the arm is attached to the base. The base 102 may be configured to be attached to (or plugged into) the connector 116.

FIG. 1*b* is a plan view of the multi-directional receiving antenna array 100 of FIG. 1*a*. The antenna array 100 includes an orientation system 118 that may correspond to the orientation of a compass 120 (which may or may not be part of antenna). The orientation system 118 may include orientation marks 122 and alignment marks 124. The orientation marks 122 may correspond to degrees of rotation up to 360° and may be included on the base 102, the arms 104, the antennas 106, or any combination thereof. The orientation marks 122 may be located adjacent to a point of rotation for the antennas 106. The alignment marks 124 may be included on the base 102, the arms 104 or the antennas 106, or any combination thereof, and may be located adjacent to a point of rotation for the antennas 106. In some embodiments, the orientation marks 122 may be used in conjunction with the alignment marks 124 to align the antennas 106 with the corresponding transmitter.

In an exemplary embodiment, the orientation marks 122 may be included on a rotating portion of the arms 104 or antennas 106 and on the base 102 near at least one arm attachment position. The orientation marks 122 may be adjacent to the alignment marks 124 included on the arms 104. Next, an exemplary positioning of one of the antennas 106 is disclosed. The base 102 may be positioned in an orientation relevant to the compass 120 for creating a reference point. The antenna 106*a* may require an orientation at a position of 225° (southwest direction) to properly receive a clear signal from a transmitter in the direction 112*a*. The arm 104*a* associated with the antenna 106*a* may be orientated to a position of 240° from the reference orientation (e.g., each arm at 120° increments starting at 0°) by aligning the orientation marks 122 on the base 102 with the alignment mark 124 on the arm 104*a*. The orientation marks 122 on the rotating portion of the arm 104*a* or antenna 106*a* may then be aligned with the alignment mark 124 on the arm 104*a* to orient the reference point to 0° by ting the antenna 106*a* in the opposite direction of the base orientation previously described. Therefore the antenna 106*a* may then be realigned to 0° (or the orientation of the compass 120). The antenna 106*a* may then be rotated 225° from the reference point using the alignment mark 124 on the arm 104*a* as an alignment guide. The antenna 106*a* may them be properly aligned in the direction 112*a* to properly receive the transmitter signal.

Figure 2:
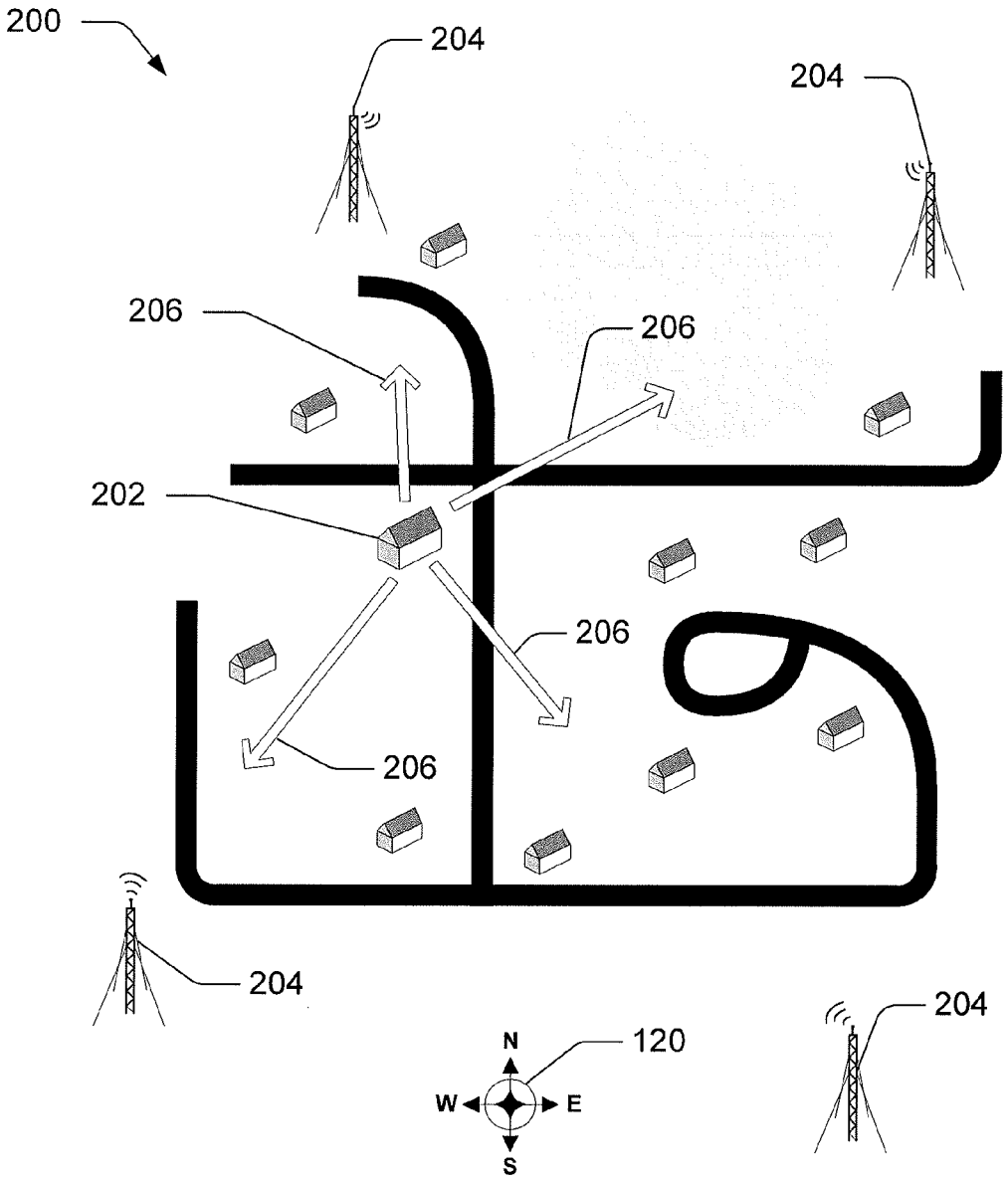
FIG. 2 is a schematic view of an illustrative multi-directional antenna array receiving location and surrounding signal transmitters, showing how a system may be organized.

FIG. 2 is a schematic of an exemplary map 200 of a multidirectional antenna array receiving location and surrounding signal transmitters, and showing how such a system may be organized. The map 200 includes a location 202, such as a residential home. The location 202 is surrounded by a number of transmitters 204. The transmitters 204 are configured to transmit radio waves for broadcasting television or radio station radio waves through airwaves. Each transmitter 204 is located in a distinct location.

The transmitters 204 are located in directions 206 from the location 202. For example, a location may have the network station data presented in Table 1 for the particular location 202.

TABLE 1

Sample Network Station Broadcast Information

| TYPE | NETWORK | CHANNEL | COMPASS | DISTANCE | FREQUENCY |
|---|---|---|---|---|---|
| UHF | PBS | 21.1 | 147° | 2.4 miles | 21 |
| UHF | FOX | 5.1 | 68° | 1.6 miles | 27 |
| UHF | ABC | 2.1 | 187° | 1.6 miles | 39 |
| VHF | NBC | 11.1 | 146° | 2.7 miles | 10 |
| UHF | CBS | 46.1 | 42° | 1.7 miles | 19 |

Each location 202 may have a unique table that provides information specific to the location 202. Table 1 includes the type of antenna including UHF or VHF. The network is the station call signal, such as CBS for Columbia Broadcasting System, The channel may be the channel number a user accesses on a television tuner to view the broadcast signal. The compass direction may be the direction of a tower in relation to the location 202. Alternatively, the location of the transmitter 204 may be provided, such as by latitude and longitude. This may allow a user to calculate the compass direction from the location 202 if the coordinates of the location are known. The distance from the location 202 to a tower and/or the transmitter 204 may also be provided. The distance may be relevant when a tower and/or the transmitter 204 is outside a threshold distance. For example, transmitters over seventy miles from the receiving location may experience interference from the effects of the curvature of the earth. The frequency assignment may also be provided to allow the location 202 to properly tune an antenna to receive the broadcast from the corresponding station.

The data provided in Table 1 may be compiled from one or more sources. For example, the location of the antenna, or compass data, may be found by taking a global positioning system (GPS) reading of the transmitter location, researching information from the station's website on the internet or other station information document, from a specialty provider of this information, by trial and error, or by other methods. In some embodiments, the data necessary to populate the Table 1 may be provided by a service associated with setting up an antenna array, such as the antenna array 100, with one or more antennas, such as the antennas 106, orientated using the information provided in a table, such as Table 1. For example, the data in Table 1 may be provided electronically.

Figure 3:
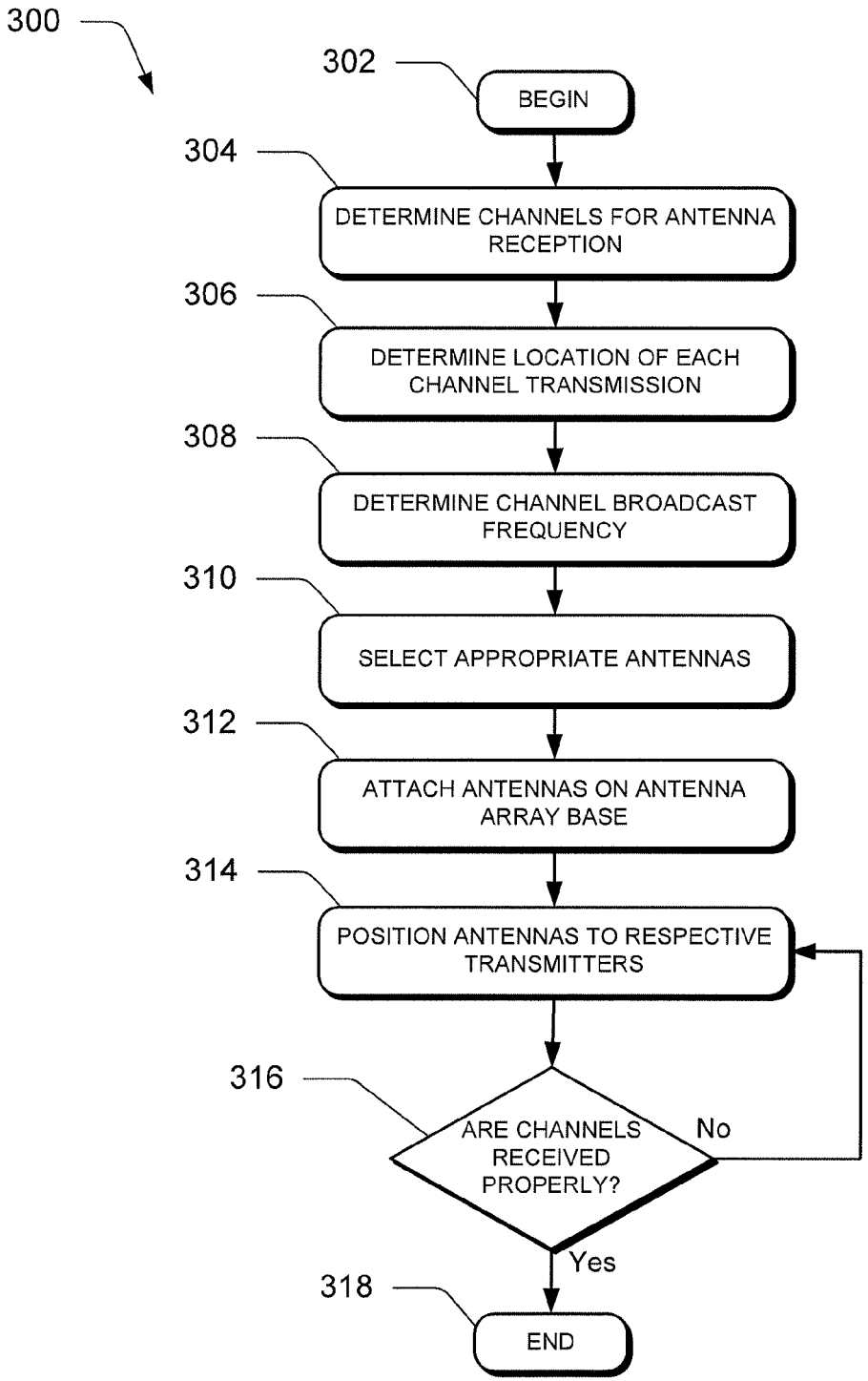
FIG. 3 is a flow diagram showing an illustrative way customizing a array directional receiving antenna array.

FIG. 3 is a flow diagram of a process 300 for customizing a multidirectional receiving antenna array, such as the antenna array 100. At a block 302, the process 300 begins. At a block 304, the channels for antenna reception are determined For example, a user may decide to configure the antenna array 100 to receive all of the stations listed in Table 1 above, while not including other channels that may be broadcast and may be undesirable to the user. At a block 306, the location of each channel transmission is determined. At a block 308, the channel broadcast frequency associated with each of the channels is determined. The location of each channel transmission and the broadcast frequency may be determined in the same manner as those included in Table 1 above. In one embodiment, the location of each channel transmission and the broadcast frequency may be downloaded from an internet website after the user inputs the address for reception of the broadcast signals (e.g., the user's home address).

At a block 310, the user selects the appropriate antennas, such as the antennas 106, to receive the broadcast stations selected at the block 304. For example, the user may select a bow tie antenna (i.e., UHF fan dipole) to receive a first signal having a UHF signal while a telescoping dipole antenna may be used to receive a second signal. At a block 312, the antennas 106 selected at the block 310 may be attached to the antenna array base 102. The attachment process may include providing antenna arms, such as the antenna arms 104, to link the antennas 106 to the antenna array base 102. In addition, the mounting of the arms 104 may include rotating the arms or adjusting the arm length to provide an appropriate antenna position, such that the antennas 106 do not touch each other or otherwise cause interference among one another.

At a block 314, the antennas 106 are positioned toward a corresponding transmitter in order to properly receive the broadcast signal. The antennas 106 may be positioned by using the compass data from Table 1, or similar antenna positioning data. Further, the orientation system 118, including the orientation marks 122 and alignment marks 124, may be used to position the antennas 106 situated in the antenna array 100 to the proper broadcast transmitter directions. At a decision block 316, the proper reception of the broadcast signals is verified. If the broadcast signals are not properly received, then via a 'no' route, the process 300 returns to the block 314 to reposition the antennas 106 toward the respective transmitters. If the broadcast signals are properly received at the decision block 316, then the process 300 advances via the 'yes' route and ends at a block 318.

In further embodiments, one or more antennas, such as the antennas 106, may be rotated by a motor. The motor may be controlled by user input to orient or tune the antennas. Alternatively or additionally, the motor may be controlled automatically, such as from instructions generated electronically from data similar to the information included in Table 1, Therefore, the antenna array 100 may be configured for automatic orientation of the one or more antennas 106.

FIGS. 4*a*, 4*b*, and 4*c* are exemplary schematics of a multidirectional receiving antenna array 400, while FIGS. 4*d* and 4*e* are isometric views of the same, allowing for customization by a user and showing how the antenna array 400 may be customized. FIG. 4*a* illustrates a substantially flat version of the antenna array 400 for customization by a user. The antenna array 400 is formed on a planar substrate 402. The planar substrate 402 may include conductive elements 404 (illustrated with shading) and non-conductive elements 406 (illustrated without shading). The conductive elements 404 facilitate the reception of broadcast signals over the air. The non-conductive elements 406 insulate the conductive elements 404 from each other.

The planar substrate 402 may also include a center channel 408 of nonconductive material to further divide the conductive elements 404 into distinct elements. The center channel 408 may include conductive wires 410 and 412, which run lengthwise along the center channel 408 and connect the conductive elements 404 on either side of the center channel 408. As a reference for the conductive elements 404, a guide 414 may be located on the planar substrate 402 to individually identify the conductive elements 404. Although the guide 414 is shown to the side of the planar substrate 402 for convenience, it should be appreciated that the guide may be integrated on the planar surface 402.

In order to customize the antenna array 400, the process described in FIG. 3 may be conducted. Therefore, a number of antenna specifications may be selected, each identifying a particular antenna requirement (e.g., frequency and direction). Having obtained the antenna requirements, the planar substrate 402 can be customized to include only the required antenna elements for a particular location application. In an example, a user may desire to receive broadcast channels that correspond to the elements (a), (f), and (j) in the guide 414. Therefore, the planar substrate 402 may be customized to include only the conductive elements 404 necessary to receive the desired broadcast signals.

FIG. 4*b* depicts element lines 416 and reduction lines 418. The element lines 416 indicate the ideal length of each conductive element 404 after the conductive elements have been customized, such as by cutting and removing the conductive element at the element line to create a proper length (tuned) conductive element. For example, after removing the conductive material, the conductive element (f) will be approximately half the length of the conductive element (a), as identified by the guide 414. The reduction lines 418 are determined once the conductive elements 404 for removal are identified, such as (b)-(e), (g)-(h), and (k)-(p). Thus, the reduction lines 418 indicate to remove non-utilized conductive elements 404 such that only utilized conductive elements remain, such as elements (a), (f), and (g), as shown in FIG. 4*c*.

As previously discussed, FIGS. 4*d* and 4*e* are isometric views of FIGS. 4*a*-*c*, further illustrating customization by a user and how the antenna array 400 may be customized. In particular, FIG. 1*d* illustrates embodiments in which the planar substrate 102 is folded in order to orient the conductive elements 104 in a substantially vertical configuration; however, other configurations are contemplated. The planar surface 402 may undergo a folding process 420 to reduce the height of the planar substrate 402 from a first height 422 in FIG. 4*d* to a second height 424 in FIG. 4*e*.

FIG. 4*e* illustrates the antenna array 400 in an assembled orientation. The antenna array 400 includes a mounting bracket 426 for mounting the planar substrate 402 to a mounting location such as a roof of a home, or other adequate mounting location. The antenna array 100 further includes the non-removed conductive elements 404, including elements (a), (f), and (j). The elements 404 may be twisted on the mounting bracket 426 to direct the conductive elements 404 at their respective transmitter locations. The antenna array 400 in FIG. 11*e* may further include one or more bow tie antennas 428 (or other appropriate antennas), each directed at their respective transmitter locations. The bow tie antennas 428 may be mounted to the mounting bracket 426 separate from the folded planar substrate 402. in other embodiments, the planar substrate 402 may include one or more bow tie antennas 428 before any customization process has been initiated.

Generally speaking, the planar substrate 402 utilized in FIGS. 4*a*-4*e* may be created from any material that can facilitate the application of the conductive elements 404 and non-conductive elements 406. The planar substrate 402 may include other shapes, such as a "V" shape enclosed by the element lines 416 included in the planar substrate. In some embodiments, the planar substrate 402 may be a product enclosure, such as a box for shipping any other parts, instructions, antennas, or the like for customizing the antenna array 400.

FIG. 5 is another schematic of a multi-directional receiving antenna array 500 created by a user, and showing how the antenna array may be created. The antenna array 500 includes a printable substrate 502. The printable substrate 502 is a surface that may allow a printer, such as a computer printer, to print on the substrate. The printed substrate 502 may include printed regions 504 which include conductive material. The conductive material may be applied by the printer, such as by applying conductive ink to the printable substrate 502. The printed antenna array 500 includes the printed regions 504, each acting as one of the four antennas 106*a*-106*c*, 118 as illustrated in FIG. 1*a*. The conductive material may also be applied to the printable substrate 502 to create wires 506, 508, such as conductive wires 506, for connecting the antennas 106, 108. The printable substrate 502 may be mounted horizontally (flat surface upright) at a mounting location 510. For example, a mounting bracket, such as the mounting bracket 426, may be used to position the antenna array 500 using the mounting location 510 on the antenna array 500 location, such as on a roof of a residential home.

Although techniques for providing a customized multi-directional receiving antenna array have been described in language specific to certain features and methods, it is to be understood that the features defined in the appended claims are not necessarily limited to the specific features and methods described. Rather, the specific features and methods are disclosed as illustrative forms of implementing the claimed subject matter.

What is claimed is:

1. An antenna array comprising:

a mounting bracket;

a customized planar substrate having a first plurality of conductive elements, and from which planar substrate a second plurality of conductive elements has been removed, the customized planar substrate being attached to the mounting bracket;

wherein the customized planar substrate is folded to thereby reduce a height of the customized planar substrate; and at least one bow tie antenna coupled to the mounting bracket.

2. A method for forming an antenna array comprising:

removing a first plurality of conductive elements from a planar substrate having multiple conductive elements disposed thereon, to form a configured planar substrate with a plurality of remaining conductive elements; and folding the configured planar substrate with the remaining conductive elements to reduce a height of the configured planar substrate.

3. The method as recited in claim 2 further comprising removing non-conductive elements from the planar substrate.

4. The method as recited in claim 2 wherein removing the first plurality of conductive elements yields the antenna array operable to receive very high frequency (VHF) signals, ultra high frequency (UHF) signals, or a combination thereof.

5. The method as recited in claim 2 wherein forming the antenna array further comprises attaching the configured planar substrate to a mounting bracket.

6. The method as recited in claim 5 wherein forming the antenna array further comprises attaching one or more one bow tie antennas to the mounting bracket.

* * * * *